United States Patent [19]

Dumars

[11] Patent Number: 5,027,965

[45] Date of Patent: Jul. 2, 1991

[54] FUEL OVERFLOW COLLECTION DEVICE

[76] Inventor: Anton J. Dumars, 3340 Oak Branch Rd., John's Island, S.C. 29455

[21] Appl. No.: 539,168

[22] Filed: Jun. 18, 1990

[51] Int. Cl.[5] ..... B61C 17/02

[52] U.S. Cl. ..... 220/85 S; 383/63; 114/211; 220/85 F

[58] Field of Search ..... 220/85 F, 85 S, 86.1; 383/33, 63; 206/806, 813; 137/587, 590.5; 114/211; 440/88

[56] References Cited

U.S. PATENT DOCUMENTS

| | | | |
|---|---|---|---|
| 3,881,649 | 5/1975 | Krautsack | 206/806 X |
| 4,142,470 | 3/1979 | Zauss | 220/85 S |
| 4,353,318 | 10/1982 | Williams | 220/85 S X |
| 4,621,000 | 11/1986 | Frick | 383/33 X |
| 4,793,387 | 12/1988 | LeBlanc et al. | 220/85 F X |
| 4,796,300 | 1/1989 | Branson | 383/63 |

*Primary Examiner*—Steven M. Pollard

*Attorney, Agent, or Firm*—B. Craig Killough

[57] ABSTRACT

A fuel overflow collection device having a bag which is placed under a fuel outlet or overflow on a vehicle, such as a boat, to collect fuel spillage or overflow during the refueling process. A first embodiment is attached to a side of a vehicle, such as by adhesive means, underneath a fuel overflow so as to collect fuel therein. A second embodiment attaches to a fuel outlet or overflow so as to collect fuel overflow or spillage during the refueling process.

6 Claims, 1 Drawing Sheet

FUEL OVERFLOW COLLECTION DEVICE

BACKGROUND AND SUMMARY OF THE INVENTION

This invention relates to a collector which may be attached to a vehicle below an existing fuel overflow outlet on said vehicle so as to collect fuel exiting the overflow and prevent discharge of the fuel overflow into the environment.

Vehicles which operate on liquid fuels, particularly petroleum fuels, commonly have fuel overflow means. Fuel is placed into the vehicle, and if excess fuel is placed into the fuel tank, the excess fuel exits the vehicle through an overflow line or tube. Such overflow lines cause the excess fuel to be I discharged into the atmosphere, where such fuels become pollutants.

A common example of such a vehicle is a boat. Boats, which are frequently diesel powered, have such overflow lines. Diesel fuel is placed into the tank, and as the tank becomes full, fuel flows from the tank into an overflow line, with the discharge point of the overflow line being through the hull of the boat, causing the fuel to be discharged into the water. Such discharged fuel constitutes a pollutant which is discharged into lakes, rivers, bays, and other bodies of water.

The present invention is a collector which may be placed underneath a fuel overflow or outlet on a vehicle so as to collect the excess fuel and prevent its discharge into the environment, and particularly into water. After the fuel is collected into the bag, the bag may be removed from the vehicle and sealed for proper disposal. Two embodiments of this device are presented herein.

DETAILED DESCRIPTION OF THE DRAWINGS

DETAILED DESCRIPTION OF THE PREFERRED EMBODIMENT

In the first embodiment, a container is located underneath a fuel outlet or overflow 1. The container 3 is preferably disposable, and in this preferred embodiment is a plastic bag.

Figure 1:
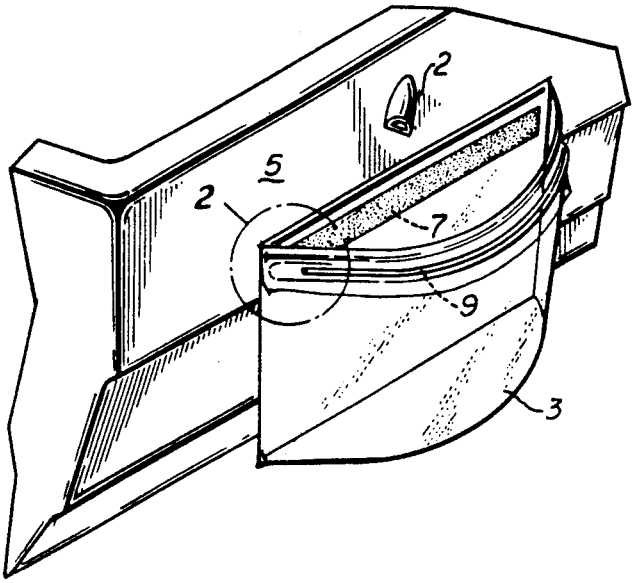
FIG. 1 is a perspective view of the first embodiment of the device, shown as the device as attached the hull of a boat, which is shown as a fragmentary view.

FIG. 1 shows container as attached to the side of a vehicle, which is a boat hull 5. The bag 3 is positioned underneath a fuel outlet or overflow 1 so that fuel exiting the fuel outlet or overflow will fall, by means of gravity, into the container 3.

In the embodiment as shown in FIG. 1, the container is attached to the boat hull 5 by an adhesive means 7. This adhesive means may be a strip 7 which is present on one side of the bag 3. The adhesive strip may have a peel off backing which is peeled from the adhesive strip, exposing the adhesive, which is then placed on the boat hull by manual pressure means so as to hold the bag in place.

The bag or container is attached to the boat as shown in FIG. 1, and fuel is placed into the boat. As excess fuel flows from the overflow, it is collected in the container, rather than being discharged into the water.

Figure 2:
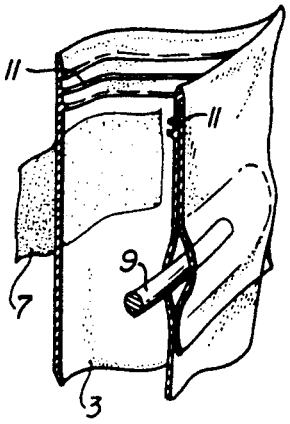
FIG. 2 is an additional view of the first embodiment of the device.

A wire or piece of plastic may be present in the upper portion of the bag or container to hold the bag in the open position as shown in FIG. 1 so that fuel will enter the bag as it is discharged from the fuel overflow. Other means could be used to hold the bag open, such as a piece of plastic. In the preferred embodiment, as detailed in FIG. 2 a wire 9 is used, since a wire may be formed as needed to hold the bag open, and formed again as needed to close the bag. Bags may be stored flat, and when the opening is spread for use, the wire will hold the bag in the open position.

At the completion of the fueling process, the bag is peeled away from the boat or other vehicle. A sealing means 11 is provided near the opening of the bag to seal the bag closed for disposal. A "zip lock" type of closure may be used, although any commonly known means for sealing a plastic bag could be used. The container having fuel therein may then properly disposed of, eliminating some of the pollution associated with the fueling process.

Figure 3:
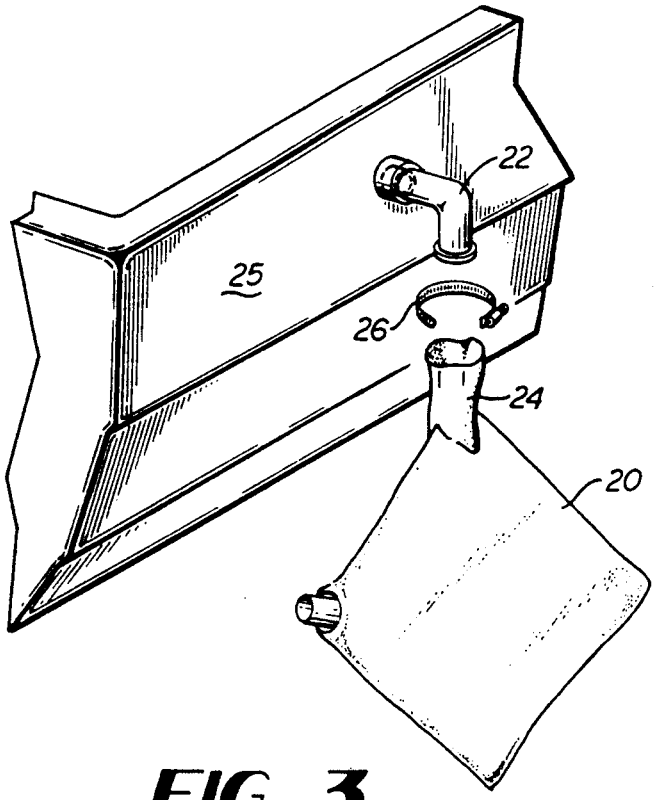
FIG. 3 is a perspective view of a second embodiment of the device, which is attached to an overflow by means of a hose clamp.

A second embodiment of the device is depicted in FIG. 3. This second embodiment again uses a disposable container which may be a plastic bag 20. Rather than attaching the container to the side of the vehicle 25, the container is attached directly to the fuel overflow outlet by a connecting means, which may be a nipple 22. This embodiment may be used when the fuel overflow outlet is a tube or other shape to which a nipple 22 may be attached. This nipple may be attached by any known means, such as by clamping, or perhaps by merely placing the nipple over the outlet. The nipple may have a bend, such as a 90° bend, as shown.

The container is attached to the overflow by placing the nipple 22 over the overflow. The container is then clamped to the nipple by placing a clamp over a neck 24 which is provided and extends from the container. A clamp, such as common hose clamp 26, may be used to preform this function. Virtually any type of clamp could be used since it is not necessary that an absolute seal be provided between the overflow and nipple, or between the nipple and container. It is only necessary that the connecting means hold the bag in place during the fueling process, and an air or liquid tight seal between the overflow and the nipple is not required.

I claim:

1. A fuel overflow collector, comprising:

a. a container;

b. an adhesive strip located on at least one side of said container for attaching said container to a vehicle underneath a fuel overflow means of said vehicle, so as to allow said container to collect fuel overflow which is expelled from said fuel overflow outlet, then allow for removal of said container and said strip from said vehicle; and c. a rigid, manually formable material located about at least a part of a perimeter of an opening of said container, wherein said rigid, manually formable material may be formed to hold said container in an open position, then formed to allow closure of said container.

2. A fuel overflow collector, comprising:

a. a plastic bag;

b. an adhesive strip located on at least one side of said plastic bag for attaching said plastic bag to a vehicle underneath a fuel overflow means of said vehicle, so as to allow said plastic bag to collect fuel overflow which is expelled from said fuel overflow outlet, then allow for removal of said container and said strip from said vehicle; and c. a rigid, manually formable material located about at least a part of a perimeter of an opening of said plastic bag, wherein said rigid, manually formable material may be formed to hold said plastic bag in an open position, then formed to allow closure of said plastic bag.

3. A fuel overflow collector as described in claim 2, wherein a closure means is provided for sealing said plastic bag.

4. A fuel overflow collector, comprising:

a. container;

b. an adhesive strip located on at least one side of said container for attaching said container to a vehicle underneath a fuel overflow means of said vehicle, so as to allow said container to collect fuel overflow which is expelled from said fuel overflow outlet, then allow for removal of said container and said strip from said vehicle; and c. a wire located about at least a part of a perimeter of an opening of said container, wherein said wire may be formed to hold said container in an open position, then formed to allow closure of said container.

5. A fuel overflow collector as described in claim 4, wherein said container is a plastic bag.

6. A fuel overflow collector as described in claim 5, wherein a closure means is provided for sealing said plastic bag.

* * * * *